United States Patent [19]

Barraire et al.

[11] 4,397,512

[45] Aug. 9, 1983

[54] ZERO INSERTION FORCE CONNECTOR, PARTICULARLY FOR AN INTEGRATED CIRCUIT

[75] Inventors: Michel Barraire; Marcel Roux; Jean P. Turolla, all of Suresnes, France

[73] Assignee: SOCAPEX, Suresnes, France

[21] Appl. No.: 235,638

[22] Filed: Feb. 18, 1981

[30] Foreign Application Priority Data

Feb. 19, 1980 [FR] France ..... 80 03575

[51] Int. Cl.[3] ..... H01R 13/639

[52] U.S. Cl. ..... 339/75 M

[58] Field of Search ..... 339/74 R, 75 R, 75 M, 339/75 MP, 75 T

[56] References Cited

U.S. PATENT DOCUMENTS 3,670,288 6/1972 Evans ..... 339/74 R 3,763,459 10/1973 Millis ..... 339/75 M

FOREIGN PATENT DOCUMENTS 2739645 3/1978 Fed. Rep. of Germany .

*Primary Examiner*—Neil Abrams

*Attorney, Agent, or Firm*—Oblon, Fisher, Spivak, McClelland & Maier

[57] ABSTRACT

A connector for components having a large number of connection lugs utilizing an insulating block having three superimposed wafers and a plurality of contacts in the form of resilient clips, the intermediate wafer being movable and providing connection with the lugs of the component by means of a pusher which it carries bearing on lateral levers carried by one of the legs of each contact parallel thereto.

5 Claims, 7 Drawing Figures

FIG_ 1
PRIOR ART
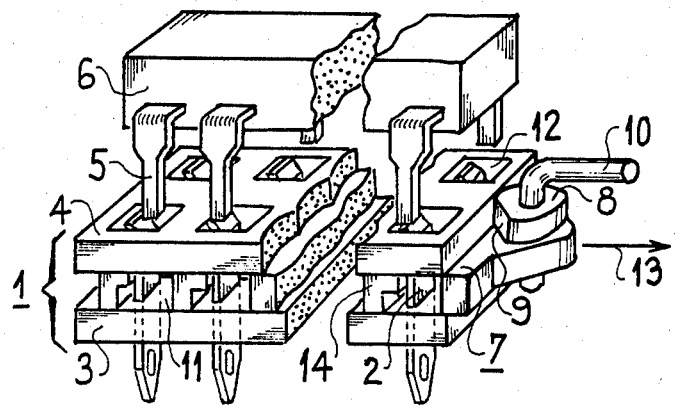
FIG_ 2-A
PRIOR ART
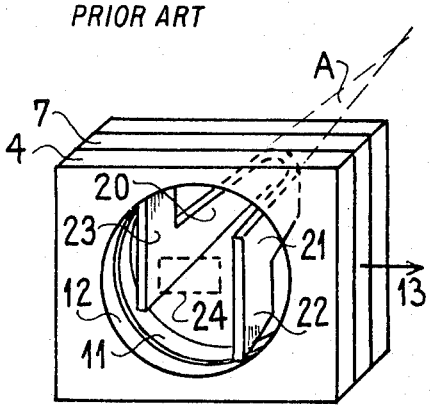
FIG_ 2-B
PRIOR ART
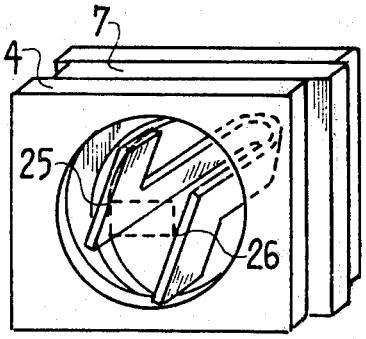

FIG_5-A
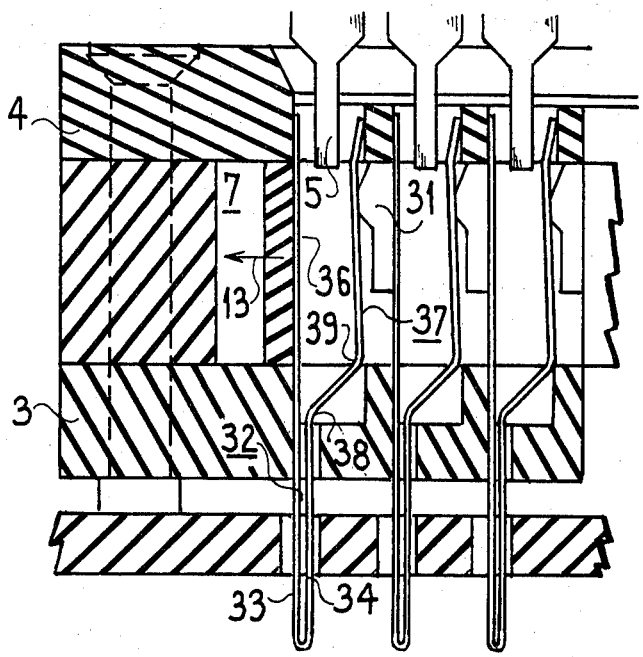
FIG_5-B
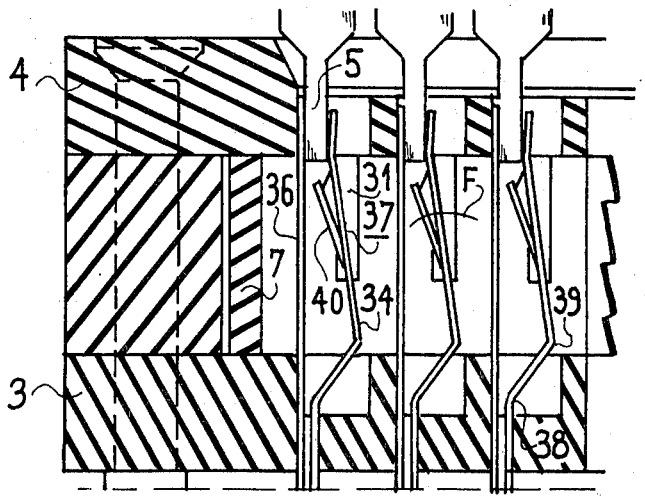

ZERO INSERTION FORCE CONNECTOR, PARTICULARLY FOR AN INTEGRATED CIRCUIT

BACKGROUND OF THE INVENTION

1. Field of the Invention

The present invention relates to the field of connectors for components having a high number of connection elements, formed by portions of flexible or rigid conductors.

2. Description of the Prior Art

The connection of such a component with the circuits or equipment in which it is used is most often carried out conductor by conductor, by processes such as soldering or wrapping for example and the time spent on each single operation may be justified in the case where the desired connection is permanent.

On the other hand, in the case where the component must be removable, either for replacement thereof after it becomes unserviceable, or for manufacturing tests or checks, the costs caused by the connection operations may be very high, and may appear very often as inadmissible. These cost constraints are particularly marked for components known as "integrated circuits," which are in the form of parallelepipedic cases having, on two of their large facing faces, a plurality of rigid connection conductors or "lugs," whose number may reach several tens.

In the case of manufacturing checks and machines for the industrial sorting of these components, connecting devices have had to be designed and proposed simultaneously providing connection of all of the lugs, by introducing them with a certain frictional contact, into an assembly of contact elements housed in support blocks made from an insulating material. However, in view of the high introduction force required in the case of a large number of lugs, connectors have been proposed of the so-called "zero insertion force" type, where the connection operation takes place in two steps, i.e. a step for introducing, without friction, the lugs into the contact elements, provided in the form of resilient twin-legged clips in which the lugs may freely penetrate in the open position, and a step for simultaneously clamping all the clips, by bringing together the legs of each clip of the assembly under the action of a common mobile pusher made from an insulating material.

However, the lugs of the integrated circuits to be connected present, in their disposition along the case of these latter, erratic-type geometric irregularities due on the one hand to manufacturing tolerances and, on the other hand, to accidental bends or twists during storage or use.

This is why there has been proposed, in the prior art, a solution in which the mobile pusher providing the clamping does not act directly on the legs of each clip, but on levers which are associated therewith, and which transmit the clamping forces to the legs of the clip with a possibility of adapting, by elasticity, the amplitude of the drawing together of the legs, to the erratic differences of position of the lugs.

But this known solution assigns to the same mechanism used, in a harmful way, multiple functions by using for example, for forming the levers, portions of the contact zones of the legs and, for forming the elements endowed with elasticity ensuring adaptation of the amplitudes, the same resilient part which ensures opening of the clip.

This confusion between the various functions of the mechanism have the serious drawback of not enabling the best results to be obtained that are normally obtainable and, moreover, leads to increasing the transverse bulk of the connector, the levers causing the clamping then being transversal.

FIG. 1 shows, in a general view, an integrated circuit connector of the prior art. The connector is formed from an insulating block 1, formed from three plates superimposed in tiers, and form a plurality of contact elements 2. The lower baseplate 3 assumes the function of support for the whole of the connector, forming the base thereof and supporting the contact elements. The upper plate 4 ensures the function of guiding the lugs 5 of the integrated circuit 6. The intermediate plate 7 is movable longitudinally, and may by translation in this direction, occupy two positions, by action on the circular cam 8, comprising a flattened part 9 and controlled by lever 10.

The operation of such connector is as follows. In the introduction position, the intermediate plate 7 has its openings 11 aligned with the openings 12 of the guiding upper plate 4. Lugs 5 of the integrated circuit may be easily introduced into the openings 11 and 12 since the contact elements are subjected to no bending force on the part of the intermediate plate 7.

In the clamping position, obtained by rotation of cam 8 under the action of lever 10, the intermediate plate 7 moves in the direction of arrow 13, applying its pushers 14 laterally on contacts 2. The latter then bend and provide clamping of lugs 5 and thus their electric connection. Such a connector presents no possibility of geometric adaptation of each contact to each lug, and the contact resistances obtained spread over a large range of values inadmissible in use.

FIG. 2 shows, in two partial views 2A and 2B, the two operating steps of the connector of FIG. 1, but provided with other contact elements of the prior art. In a three-tier structure in accordance with FIG. 1, with the same elements bearing the same reference numbers, the contact elements 2 are in the form of clip with twin legs 20 and 21, connected by a resilient connecting base allowing, moreover, connection with a user circuit by means of a lug (not shown). The end of each leg carries a perpendicularly disposed lateral lever 22 and 23, these two levers bearing on the opposite edges of the upper plate 4 and movable intermediate plate 7.

The operation of such a connector uses the same translation movement of the intermediate plate 7 in the direction of arrow 13 as in FIG. 1, but the clamping lip 2 effects two simultaneous movements.

In the open position of FIG. 2A, the legs 20,21 of the clip are spaced apart by an angle A and introduction of the lug whose contour 24 is shown with a broken line, is possible. In the clamping position shown in FIG. 2B, the respective edges of openings 11 and 12 of plates 7 and 4, having effected their relative movement, exert a bearing force on the lateral levers 22 and 23. This force produces two results, namely the two legs of the clip are successively drawn together until they contact lug 24 and then, after contact, the legs 20, 21 of the clip are twisted about the contact points 24 and 26 with the lug 24. This twisting, which allows the geometrical adaptation of each contact clip with each lug 24, is thus required of legs whose function is structurally different, i.e. that of clips for contacts. Similarly, the contact regions 25, 26 themselves assume, in addition to that of electric contact, two other functions, i.e. that as carriers for levers 22, 23 and points of rotation 25, 26. These dual functions, in the prior art, as has already been mentioned above, are harmful.

SUMMARY OF THE INVENTION

One object of providing the connector of the present invention is to avoid and overcome these disadvantages.

Basically the present invention serves to separate structurally the mechanism assuming the different functions present in a connecting clip for an integrated circuit and distinguishes separately, on the one hand, the clip, its contact means and its resilient means and, on the other hand, the clamping levers and their resilient fixing means. It is then possible to determine freely the optimum characteristics of these two parts of the integrated circuit clamping clip and moreover to orientate the clamping levers parallel to the legs of the clip, thus providing minimum dimensions in the transverse direction of the connector.

Thus, more precisely, the invention relates to a zero insertion force connector, for a component having a plurality of connection lugs, comprising an insulating block supporting a plurality of contact elements, the insulating block being formed from three parts having openings for passing said elements therethrough, which parts are in the form of wafers disposed so as to be parallely superimposed, the intermediate wafer being movable in translation, with respect to the other two, into two positions respectively for insertion and for clamping, and each contact element being in the form of a resilient clip with two legs, which connector is characterized in that each contact element carries symmetrically on one of its legs a pair of levers orientated parallel thereto, the movable wafer carrying, on each side of each aperture, a pair of projecting pushers bearing on these levers so as to ensure said clamping by said translation.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 1 shows, in a general view, an integrated circuit connector of the prior art;

FIG. 2 shows, in two partial views (a) and (b) the operating steps of such a connector, having contact elements with lateral levers;

FIG. 5 shows, in two partial sections (a) and (b), the operating steps of a connector in accordance with the invention.

DESCRIPTION OF THE PREFERRED EMBODIMENTS

Figure 3:
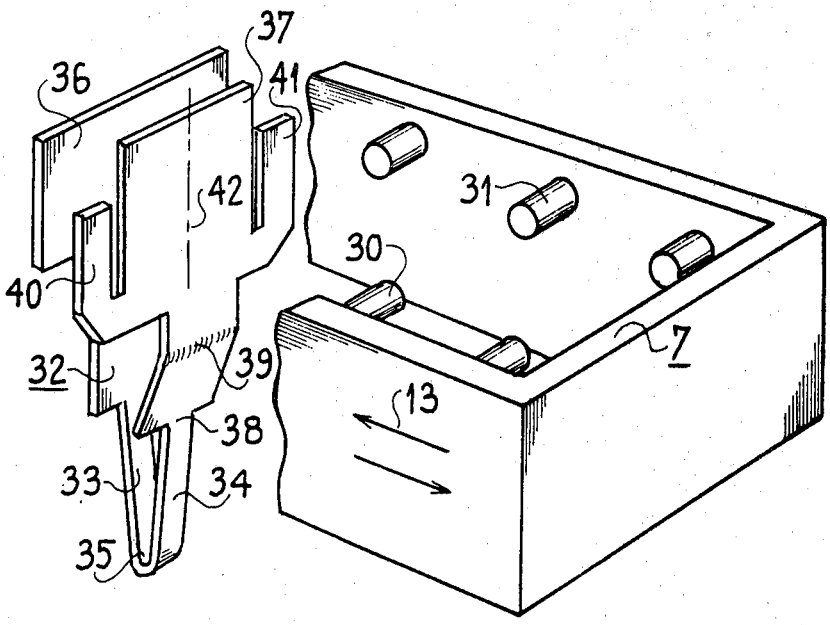
FIG. 3 shows, in partial perspective view, a first embodiment of a clamping clip for a connector in accordance with the invention.
Figure 4:
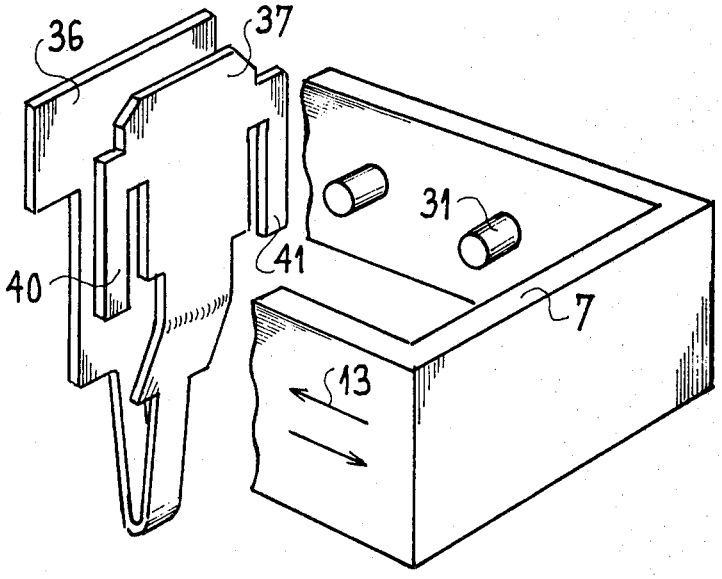
FIG. 4 shows, in a partial perspective view, a second embodiment of this clip.

FIGS. 3 and 4 show, in a partial perspective view, two embodiments of a connector clamping clip in accordance with the invention.

The intermediate plate 7 alone is shown for the sake of clarity, and it carries projecting pushers 30 and 31, disposed in pairs facing each other. The clip-shaped contact element 32 is formed from two legs 33 and 34 joined at their common end by a resilient base 35, and carrying two parts 36 and 37 ensuring the contact properly speaking, at their other end two bends in opposite directions at 38 and 39 ensure the existence of a free space between the two contact surfaces 36 and 37, for easy introduction of a connecting lug 5 of a circuit to be connected.

According to the invention, one of the legs 33, 34 carries two control levers 40 and 41, disposed symmetrically with respect to its median axis 42 and parallel thereto.

When the contact elements 32 are in place in the connector, the movable intermediate plate 7 exerts a bearing force on the levers 40 and 41 which it carries, and when it is translated, the contact clip closes again, as already explained above, on the corresponding connecting lug 5 of the circuit to be connected. FIGS. 3 and 4 only differ by the direction in which levers 40 and 41 are orientated with respect to the ends of the clip. Depending on the needs to be satisfied, the best-adapted direction should be chosen, the "leverage" offered, depending in particular on the relative dimensions of the legs, on their thickness and on the coefficient of elasticity of the metal used.

It is however possible to observe, during practical tests, that the embodiment of FIG. 3 provides a lower bearing pressure than that of FIG. 4 for an identical amplitude of the intermediate control plate. On the other hand, it seems to allow better curvature of the movable contact part of the clip about the lug of the circuit to be connected.

The advantages provided by the connector of the invention are essentially due to the fact that, as has already been discussed above in detail, the different elements present on the contact element 32 each only assume a single function, and the orientation of the control levers 40, 41 parallel to the principal median axis 42 of the contact leaves the freedom of a large choice in the length thereof without increasing the transverse bulk of the connector.

The advantages are also due to the fact that, because of the symmetry of the levers with respect to the axis of the contact, the elastic deformations brought about in the legs 33, 34 of the clip and in the levers 40, 41 are purely of the bending type, contrary to the connector of the prior art, in which twisting deformations were used, causing the risks of wide dispersion in the contact pressures obtained and their uncontrollable development in time.

FIG. 5 shows, in two partial sections 5A and 5B, the operating steps of a connector in accordance with the invention.

With the same reference numbers designating the same parts as in the two preceding figures, there is shown in FIG. 5A the connector in an open position. Each contact element 32 in the form of a clip has its two contact regions 36 and 37 substantially parallel, due to the double bend 38 and 39. The opening presented is then maximum for introducing lug 5. The intermediate plate 7 is then pushed in the direction of arrow 13, for the closure step, up to the final position shown in FIG. 5B.

Leg 34, after pivoting resiliently about bend 39 then abuts against lug 5, but pusher 31 which controls it has been able to freely continue its travel, while imparting a bending angle F on the control lever 40 whose value clearly materializes the contact pressure obtained.

The geometric compensation of the positional differences between the connecting lugs 5 of an integrated circuit is thus obtained over a large range of positions, the bending of each control lever 40 ensuring simultaneously, independently of that of the leg 33, 34 which it carries, and through an automatically adapted angle, compensation of the play and the required contact pressure sufficient to a low electrical contact resistance.

Obviously, numerous modifications and variations of the present invention are possible in light of the above teachings. It is therefore to be understood that within the scope of the appended claims, the invention may be practiced otherwise than as specifically described herein.

What is claimed is:

1. A zero insertion force connector for a component having a plurality of connecting lugs, comprising:

an insulating block supporting a plurality of contact elements, each contact element being in the form of a resilient clip having a first and second leg and wherein said insulating block further comprises an upper, intermediate and lower plate member having a plurality of openings formed therein for passage of said contact elements therethrough and wherein said plates further comprise an upper, intermediate and lower wafer member disposed so as to be superimposed in parallel, the intermediate wafer member being movable in translation with respect to the upper and lower wafer member between first and second positions, said first and second legs of said contact elements being spaced apart at said first position to such an extent that said connecting lugs of said component can be inserted into said connector without friction, and said first and second legs of said contact elements clamp said lugs of said component in said second position in order to hold said component in position, each said contact element symmetrically carrying solely on said first leg a pair of levers oriented parallel thereto, each lever being separated from said first leg by a slotted region, and wherein said intermediate movable wafer member further comprises, on each side of each opening thereof, a projecting pusher, each pusher cooperating respectively with said levers at the level of the slotted region of each lever so that displacement of the levers under the action of each of said pushers results in displacement of said first leg of each contact element such that said plurality of connecting lugs are resiliently clamped.

2. The connector as claimed in claim 1, wherein each of said levers are oriented towards a free end portion of said first leg.

3. The connector as claimed in claim 1, wherein each of said levers are oriented in a direction opposite to that of a free end portion of said first leg.

4. The connector as claimed in claim 1, wherein said first leg of said resilient clip which carries said levers has a first and second transverse bend in opposite directions such that said first and second legs are oriented parallel in said first position.

5. The connector as claimed in claim 4, wherein said first leg of said resilient clip which carries said levers further comprise means for resiliently pivoting said levers about one of said first and second transverse bends when said intermediate wafer member is moved between said first and second position.

* * * * *